US008383309B2

(12) United States Patent
Wang et al.

(10) Patent No.: US 8,383,309 B2
(45) Date of Patent: Feb. 26, 2013

(54) PREPARATION OF SUBLIMATION COLORANT DISPERSION

(75) Inventors: Yulin Wang, Oakville (CA); Ke Zhou, Oakville (CA); Edward G. Zwartz, Mississauga (CA); T. Hwee Ng, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/611,336

(22) Filed: Nov. 3, 2009

(65) Prior Publication Data

US 2011/0104607 A1 May 5, 2011

(51) Int. Cl.
*G03G 9/09* (2006.01)

(52) U.S. Cl. ..... 430/109.1; 430/109.4; 430/110.3

(58) Field of Classification Search ..... 430/109.1, 430/109.4, 110.3
See application file for complete search history.

(56) References Cited

U.S. PATENT DOCUMENTS 3,847,604 A 11/1974 Hagenbach et al.
4,081,277 A 3/1978 Brault et al.
4,105,572 A * 8/1978 Gorondy ..... 430/106.2
4,295,990 A 10/1981 Verbeek et al.
4,302,201 A * 11/1981 Hasegawa et al. ..... 8/444
RE31,072 E 11/1982 Jadwin et al.
4,536,462 A * 8/1985 Mehl ..... 430/108.2
4,935,326 A 6/1990 Creatura et al.
4,937,166 A 6/1990 Creatura et al.
5,278,020 A 1/1994 Grushkin et al.
5,290,654 A 3/1994 Sacripante et al.
5,308,734 A 5/1994 Sacripante et al.
5,324,612 A * 6/1994 Maeda et al. ..... 430/109.4
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,382,490 A * 1/1995 Yamamura et al. ..... 430/110.2
5,403,693 A 4/1995 Patel et al.
5,405,728 A 4/1995 Hopper et al.
5,409,557 A 4/1995 Mammino et al.
5,418,108 A 5/1995 Kmiecik-Lawrynowicz et al.
5,436,217 A 7/1995 Van Steen et al.
5,487,707 A 1/1996 Sharf et al.
5,496,676 A 3/1996 Croucher et al.
5,501,935 A 3/1996 Patel et al.
5,514,436 A 5/1996 Schlueter, Jr. et al.
5,527,658 A 6/1996 Hopper et al.
5,555,813 A 9/1996 Hale et al.
5,585,215 A 12/1996 Ong et al.
5,593,807 A 1/1997 Sacripante et al.
5,650,255 A 7/1997 Ng et al.
5,650,256 A 7/1997 Veregin et al.
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,869,215 A 2/1999 Ong et al.
5,902,771 A 5/1999 Slark et al.
5,917,530 A 6/1999 Hutt et al.
6,052,139 A 4/2000 Hetzer
6,057,264 A 5/2000 Bradbury
6,099,673 A 8/2000 Van Bennekom
6,270,933 B1 8/2001 Thompson
6,408,753 B1 6/2002 Finn et al.
6,800,166 B2 10/2004 Kosaka et al.
6,849,311 B2 2/2005 Yoshinari et al.
6,946,424 B2 9/2005 Ieshige et al.
6,951,696 B2 10/2005 Ozaki
7,029,817 B2 4/2006 Robinson et al.
7,033,974 B2 4/2006 Ishida et al.
7,138,163 B2 11/2006 Ieshige et al.
7,329,476 B2 2/2008 Sacripante et al.
7,432,324 B2 10/2008 Chen et al.
7,510,617 B2 3/2009 Kosaka et al.
2005/0026061 A1 * 2/2005 Mikuriya et al. ..... 430/108.1
2005/0137278 A1 6/2005 Fromm et al.
2005/0191573 A1 9/2005 Smith
2006/0100300 A1 5/2006 Sacripante et al.
2006/0216626 A1 9/2006 Sacripante et al.
2007/0141495 A1 * 6/2007 Sweeney ..... 430/108.2
2008/0107990 A1 5/2008 Field et al.
2008/0131800 A1 * 6/2008 Marsh et al. ..... 430/59.6
2008/0153027 A1 * 6/2008 Veregin et al. ..... 430/113
2008/0182193 A1 * 7/2008 Agur et al. ..... 430/109.4
2008/0193869 A1 * 8/2008 Vanbesien et al. ..... 430/108.4
2008/0199797 A1 * 8/2008 Sacripante et al. ..... 430/104
2008/0236446 A1 10/2008 Zhou et al.
2009/0047593 A1 2/2009 Vanbesien et al.
2009/0202930 A1 * 8/2009 Furukawa et al. ..... 430/105
2009/0220882 A1 * 9/2009 Zhou et al. ..... 430/109.3

OTHER PUBLICATIONS

Machine English language translation of JP 2005221892 Aug. 2005.*

* cited by examiner

*Primary Examiner* — Hoa V Le
(74) *Attorney, Agent, or Firm* — Oliff & Berridge, PLC

(57) ABSTRACT

A chemical toner composition that includes at least one curable amorphous resin and at least one sublimation colorant.

15 Claims, No Drawings

PREPARATION OF SUBLIMATION COLORANT DISPERSION

BACKGROUND

The present application is directed to a chemical toner containing a curable amorphous resin and sublimation colorant for a second transfer process. As described herein, the phrase "chemical toner" refers to toner prepared by newer chemical methods as contrasted with an older generation toner which is prepared by mechanical grinding processes. "Chemical toner" can be prepared by a variety of processes including for example emulsion aggregation (to result in "emulsion aggregation toner") and suspension polymerization.

Emulsion aggregation (EA) toners are used in forming print and/or xerographic images. Emulsion aggregation techniques typically involve the formation of an emulsion of the resin particles, which particles have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally also with additional resin, is separately formed. The colorant dispersion is added to the emulsion latex mixture, and an aggregating agent or complexing agent is then added and/or aggregation otherwise initiated to form aggregated toner particles. The aggregated toner particles are heated to enable coalescence/fusing, thereby achieving aggregated, fused toner particles. United States patents describing emulsion aggregation toners include, for example, U.S. Pat. Nos. 5,370,963, 5,418,108, 5,290,654, 5,278,020, 5,308,734, 5,344,738, 5,403,693, 5,364,729, 5,346,797, 5,348,832, 5,405,728, 5,366,841, 5,496,676, 5,527,658, 5,585,215, 5,650,255, 5,650,256, 5,501,935, 5,723,253, 5,744,520, 5,763,133, 5,766,818, 5,747,215, 5,827,633, 5,853,944, 5,804,349, 5,840,462, and 5,869,215.

However, chemical toners have not been employed in transfer printing processes. Transfer printing is a process in which an image is first printed onto a transfer carrier sheet and then "transferring" that image onto a permanent image-receiving surface. The transfer may be accomplished by placing the transfer carrier sheet with the image printed thereon in contact with said surface of the article, and applying either heat or force to the transfer carrier sheet until the image transfers onto the article surface.

The use of sublimable dyes in transfer printing processes has been commercially practiced for more than 50 years. Creating the images to be transferred has been accomplished using established imaging technologies such as off-set press, silk screen, and ink jet methods, or the like. The image is usually formed on paper using inks containing sublimable dye colorants. The transfer paper decals are then brought into contact with the textile or other material to be decorated and with the application of heat, about 100° C. to 300° C., and pressure, to assure intimate contact between the donor and receptor, the dye is vaporized and transferred as a gas, image-wise, to the receptor. Thus, a permanent image is fowled.

Sublimable dyes colorants are generally obtained by dispersing the subliminable dye into an aqueous solution including water, an organic solvent and a dispersant. In typical ink jet recording systems, the ink should be ejected from thin nozzles as ink droplets to ensure the ink does not smear and is printed in the desired location on the substrate. Furthermore, unlike water-soluble dyes, the sublimation colorant in the transfer printing ink tends to aggregate on the surface of the printhead nozzle and clog the printhead nozzle. This aggregation is believed to be caused by evaporation of moisture during the storage of the sublimation colorant. Still further, the water soluble organic solvent used to disperse the subliminable dye is evaporated with water during the heat treatment and can cause substantial environmental pollution and/or safety concerns.

To formulate process color thermal transfer dye sublimation toner, one must ensure that only the sublimation colorant component transfers to the secondary substrate, and thus that the remaining toner formulation remains on the transfer sheet.

For the past three decades, toners have been formulated to retard their inherent tendency to adhere to hot surfaces. For examples, as described by U.S. Pat. No. Re 31,072 to Jadwin, high molecular weight and especially cross linked polymers may be incorporated into the toner formulation. Another means of solving this problem involves the incorporation of internal lubricating agents, such as waxes. A third solution is the incorporation of inert, preferably organic fillers, such as metal oxides, carbonates and the like, to act as flatting agents and which retard tack in most resins. The incorporation of two or more of these approaches is especially effective in preventing mass transfer of the toner to the receptor substrate during sublimation transfer of the dye image.

Attempts at the inclusion of sublimable dyes into toners are seen for example, in U.S. Pat. Nos. 5,555,813 and 4,536,462, each of which are incorporated by reference herein in their entirety. U.S. Pat. No. 5,555,813 describes a toner containing a sublimable dye intended for use in the preparation of images to be transferred to a secondary substrate. U.S. Pat. No. 5,555,813 teaches, however, that in order to transfer the sublimable dye component a molecular sieve, such as a zeolite, must be included in the toner composition to assist in dye transfer. The molecular sieve retains the dye in its voids and then transfers the dye upon heating at elevated temperatures. U.S. Pat. No. 4,536,462 also discusses the use of sublimation dyes to prepare toner compositions. The toner is a monochrome, magnetic toner product. This teaching requires the inclusion of a surfactant in the composition in order to achieve good image development. As these patents demonstrate, the inclusion of sublimation dyes into toners for color processing requires special considerations.

U.S. Pat. No. 6,270,933, which is incorporated by reference herein in its entirety, describes the inclusion of a high molecular weight polyester resins with a molecular weight above about 75,000, such as about 300,000. These polymer materials do not melt and become tacky at the temperatures needed to cause sublimation of the disperse dye components, and therefore are not likely to transfer freely to the secondary substrate. However, U.S. Pat. No. 6,270,933 further describes that the use of lower molecular polyester resins, such as crystalline polyester resins and amorphous polyester resins, become very tacky and sticky at the elevated temperatures required to the sublime the sublimation dyes and thus makes clean transfer of the dye to the substrate "impossible."

SUMMARY

What is still desired is a chemical toner comprising a curable amorphous resin and a sublimation colorant, which can produce a full color image in the reverse format on a transfer sheet. Such a toner would thus be suitable for all transfer printing processes using a toner with a sublimation colorant component and a curable amorphous resin.

The above and other issues are addressed by the present application, wherein in embodiments, described is a chemical toner composition comprising at least one curable amorphous resin and at least one sublimation colorant.

In embodiments, described is a chemical toner composition having toner particles comprising at least one curable amorphous resin, optionally one or more crystalline resin, optionally one or more radiation curable initiator, at least one aggregating agent and at least one sublimation colorant.

In embodiments, described is a transfer printing method, the method comprising: applying an emulsion aggregation toner composition in a desired pattern onto a transfer sheet to form an image on the transfer sheet, the toner composition comprised of at least one curable amorphous resin and at least one sublimation colorant, curing the image on the transfer sheet, bringing the transfer sheet into pressure contact with the permanent image-receiving substrate and heating the transfer sheet, and forming an image on the permanent image-receiving substrate.

EMBODIMENTS

Described herein is a chemical toner composition comprising at least one curable amorphous resin and at least one sublimation colorant.

Curable Amorphous Resin

In embodiments, the chemical toner composition includes at least one curable amorphous resin, such those described in U.S. patent application Pub. No. 2005/0191573, which is incorporated by reference herein in its entirety. A curable resin is a resin that may be cured during a powder coating technique. The term "curable" refers, for example, to the component or combination of components being polymerizable, that is, a material that may be cured via polymerization, including for example free radical routes, and/or in which polymerization is photoinitiated through use of a radiation sensitive photoinitiator.

Examples of curable amorphous resins include epoxy resins, poly-functional epoxy resins, unsaturated polyester resins, carboxy-functional polyester resins, hydroxy-functional polyester resins, polyol resins, polycarboxylic acid resins, poly(epoxy-acrylic acid)-unsaturated polyimide resins, unsaturated polyamide resin, unsaturated polycarbonate resins, and mixtures thereof.

In embodiments, the curable amorphous resin is an unsaturated resin. As such, the unsaturated resin is a polymer that is unsaturated, and can be crosslinked in the presence of activating radiation such as ultraviolet light and a suitable photo initiator.

In further embodiments, the curable amorphous resin is an unsaturated polyester resin comprising fumarate or maleate groups. Examples of suitable unsaturated polyester resin comprising fumarate or maleate groups include poly(propoxylated bisphenol-fumarate), poly(ethoxylated bisphenol-fumarate), poly(butyloxylated bisphenol-fumarate), poly (propoxylated bisphenol-maleate), poly(ethoxylated bisphenol-maleate), poly(butyloxylated bisphenol-maleate), copoly(diethylene-propylene terephthalate)-copoly(diethylene-propylene fumarate), copoly(propylene-terephthalate)-copoly(propylene-fumarate), copoly(diethylene-propylene terephthalate)-copoly(diethylene-propylene maleate), copoly(propylene-terephthalate)-copoly propylene-maleate), mixtures thereof and the like.

Unsaturated polyester resins, which are available from a number of sources, can possess various glass transition temperature of, for example, from about 30° C. to about 90° C., such as from about 35° C. to about 80° C. as measured by differential scanning calorimetry (DSC). The unsaturated polyester resin may have, for example, a number average molecular weight ($M_n$), as measured by gel permeation chromatography (GPC) of, for example, from about 1,000 to about 75,000, such as from about 2,000 to about 50,000. The weight average molecular weight ($M_W$) of the curable amorphous resin is 150,000 or less, for example, from about 2,000 to about 100,000, and from about 3,000 to about 50,000, as determined by GPC using polystyrene standards. The molecular weight distribution ($M_w/M_n$) of the unsaturated polyester resin is, for example, from about 2 to about 6, and more specifically, from about 2 to about 4.

In embodiments, the curable amorphous resin may be a thermal curable resin obtained from the reaction of an epoxy functionalized resin with a catalyst and polyol or an acid functionalized resin, such as polyacrylic acid, polymethacrylic acid, polystyrene acrylic acid, polystyrene methacrylic acid, polyester with acid end groups and the like. Thermal curable resins, may also be derived from a polyol and a difunctionalizes isocyanate organic compound such as, for example, benzene diisocyanate, toluene diisocyanate, diphenylmethane diisocyanate, 1,6-hexamethylene diisocyanate, bis(4-isocyanatocyclohexyl)-methane, MODUR CB-60, MONDUR CB-75, MONDUR MR, MONDUR MRS 10, PAPI 27, PAPI 135, Isonate 143L, Isonate 181, Isonate 125M, Isonate 191, Isonate 240, and E-Caprolactam blocked isocyanate polymer.

In embodiments, the curable amorphous resin can be derived from the addition polymerization of a mixture of olefinic monomers comprised of styrene, alkyl acrylate and/or alkyl methacryate, acrylic acid, methacrylic acid and/or β-carboxyethylacrylate, glycidyl acrylate and/or glycidyl methacrylate. For example, a toner resin has the formula of:

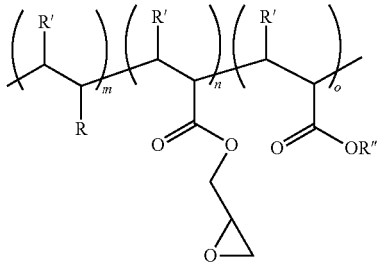

wherein R is a mixture of phenyl and carboxy-alkylate substituent, R' is a hydrogen or methyl substituent, and R" is a hydrogen or ethylcarboxylic acid substituent, and m, n and o are integers that represent segmental units of the resin that are randomly distributed within the resin.

The chemical toner composition may also include an optional curing agent. Examples of curing agents include epoxy phenol novolacs and epoxy cresol novolacs; isocyanate curing agents blocked with oximes, such as isopherone diisocyanate blocked with methyl ethyl ketoxime, tetramethylene xylene diisocyanate blocked with acetone oxime, and Desmodur W (dicyclohexylmethane diisocyanate curing agent) blocked with methyl ethyl ketoxime; light-stable epoxy resins such as "Santolink LSE 120" supplied by Monsanto; alicyclic poly-epoxides such as "EHPE -3150" supplied by Daicel; polyfunctional amines; dicyanodiamide; bisphenol A; bisphenol S; hydrogenated bisphenol; polyphenolics; imidazoles, such as 2-methyl imidazole and 2-phenyl imidazole; betahydroxy-alkylamide; uretdione; and polyfunctional isocyanates, such as 2,4-toluene diisocyanate, 2,6-toluene diisocyanate, alkaline diisocyanates, xylene-diisocyanate, isophorone-diisocyanate, methylene-bis(4-phenyl isocyanate), methylene-bis-(4-cyclohexyl)isocyanat-e, 3,3'-bitoluene -4-4'-diisocyanate, hexamethylene-diisocyanate, and naphthalene 1,5-diisocyanate; as well as other known or later developed curing agents and initiators.

The chemical toner composition may also include optionally one or more crystalline polyester resin. As used herein, "crystalline" refers to a polyester with a three dimensional order. "Semicrystalline resins" as used herein refers to resins with a crystalline percentage of, for example, from about 10 to about 90%, and more specifically from about 12 to about 70%. Further, as used hereinafter "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

Illustrative examples of crystalline polyester resins may include any of the various crystalline polyesters, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecanedioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl) -copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl) -copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl) -copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl) -copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl) -copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl) -copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo -isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl) -copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl) -copoly(hexylene-adipate) and combinations thereof.

The crystalline polyester resins, which are available from a number of sources, may possess various melting points of, for example, from about 30° C. to about 120° C., such as from about 50° C. to about 90° C. The crystalline resin may have, for example, a number average molecular weight ($M_n$), as measured by gel permeation chromatography (GPC) of, for example, from about 1,000 to about 50,000, such as from about 2,000 to about 25,000. The weight average molecular weight ($M_w$) of the resin is 50,000 or less, for example, from about 2,000 to about 50,000, and from about 3,000 to about 40,000, as determined by GPC using polystyrene standards. The molecular weight distribution ($M_w/M_n$) of the crystalline resin is, for example, from about 2 to about 6, and more specifically, from about 2 to about 4.

The crystalline resin may be prepared by a polycondensation process by reacting suitable organic diol(s) and suitable organic diacid(s) in the presence of a polycondensation catalyst. Generally, a stoichiometric equimolar ratio of organic dial and organic diacid is utilized, however, in some instances, wherein the boiling point of the organic dial is from about 180° C. to about 230° C., an excess amount of diol can be utilized and removed during the polycondensation process. The amount of catalyst utilized varies, and may be selected in an amount, for example, of from about 0.01 to about 1 mole percent of the resin. Additionally, in place of the organic diacid, an organic diester can also be selected, and where an alcohol byproduct is generated.

Examples of organic dials selected for the preparation of crystalline polyester resins include aliphatic dials with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic dials such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfa-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfa-p-hydroxybenzoic acid, N,N-bis(2-hydroxyethyl)-2-amino ethane sultanate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin.

Suitable crystalline polyester resins include those disclosed in U.S. Pat. No. 7,329,476 and U.S. Patent Application Pub. Nos. 2006/0216626, 2008/0107990, 2008/0236446 and 2009/0047593, each of which is hereby incorporated by reference in their entirety. In embodiments, a suitable unsaturated crystalline resin may include a resin composed of ethylene glycol and a mixture of dodecanedioic acid and fumaric acid co-monomers with the following formula (I):

(I)

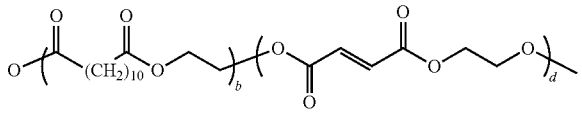

wherein b is from 5 to 2000 and d is from 5 to 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly (decamethylene adipate), poly(decamethylene azelate), poly (hexamethylene oxalate), poly(decamethylene oxalate), poly (ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly (tetramethylene trithiodicarboxylate), poly(trimethylene dodecane dioate), poly(m-xylene), polyp-xylylene pimelamide), and combinations thereof.

Examples of suitable polycondensation catalyst for either the curable amorphous resin or crystalline polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

The curable amorphous resin or crystalline polyester resin may be a branched resin. As used herein, the terms "branched" or "branching" includes branched resin and/or cross-linked resins. Branching agents for use in forming these branched resins include, for example, a multivalent polyacid such as 1,2,4-benzene -tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl)methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanethiol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for the in situ pre-wise reactions between both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins are prepared by melt polycondensation or other polymerization processes using diacids and/or anhydrides and diols.

The monomers used in making the selected curable amorphous resin or crystalline polyester resin are not limited, and the monomers utilized may include any one or more of, for example, ethylene, propylene, and the like. Known chain transfer agents, for example dodecanethiol or carbon tetrabromide, can be utilized to control the molecular weight properties of the polyester. Any suitable method for forming the curable amorphous or crystalline polyester from the monomers may be used without restriction.

The curable amorphous resin and crystalline polyester resin may be present in an amount of from about 65 to about 99 percent by weight, such as about 75 to about 97 percent by weight, of the toner particles (that is, toner particles exclusive of external additives) on a solids basis. The ratio of crystalline resin to amorphous resin can be in the range from about 0:100 to about 50:50, such as from about 5:95 to about 35:65. However, amounts and ratios outside of these ranges can be used, in embodiments, depending upon the type and amounts of other materials present.

One, two, or more curable amorphous resins and/or crystalline polyester resins may be used. In embodiments where two or more of these toner resins are used, the toner resins may be in any suitable ratio (for example weight ratio) such as for instance about 5% (first resin)/95% (second resin) to about 95% (first resin)/5% (second resin).

Preparation of Resin Emulsion

The toner particles described herein may be made by any suitable chemical process such as emulsion polymerization and suspension polymerization. Depending on the preparation method, the latex particles may have a very narrow size distribution or a broad size distribution.

For the purpose of illustration the embodiments described herein, the curable amorphous resin emulsion will be discussed below in reference to an emulsion polymerization method. An example of a method for generating a resin emulsion, optionally containing one or more photo-initiator, for the production of toner particles having the polyester resin is disclosed in U.S. Pat. No. 7,029,817, which is incorporated herein in its entirety by reference. Emulsion aggregation toner dispersions may be generated by other processes including, but not limited to, the melt mixing process disclosed in U.S. Pat. No. 7,432,324, which is incorporated herein in its entirety by reference, and the phase inversion process.

The toner particles may be created by the emulsion aggregation (EA) process, which are illustrated in a number of patents, such as U.S. Pat. No. 5,593,807, U.S. Pat. No. 5,290,654, U.S. Pat. No. 5,308,734, and U.S. Pat. No. 5,370,963, each of which are incorporated herein by reference in their entirety.

In embodiments, toner compositions may be prepared by any of the known emulsion-aggregation processes, such as a process that includes aggregating a mixture of a sublimation colorant and any other desired or required additives, and the emulsion comprised of the curable amorphous resin, and then coalescing the aggregate mixture. The curable amorphous resin emulsion may be prepared by dissolving the curable amorphous resin, optionally one or more radiation curable initiator, in a suitable solvent. In embodiments, the resin emulsion is prepared by dissolving the amorphous polyester resin and the optional crystalline polyester resin in a solvent.

In embodiments, the toner particles described herein may be radiation curable. Thus, for example, the term "radiation curable" is intended to cover all forms of curing upon exposure to a radiation source, including light and heat sources and including in the presence or absence of initiators. Example radiation curing routes include, but are not limited to, curing using ultraviolet (UV) light, for example having a wavelength of 200-400 nm or more rarely visible light, such as in the presence of photoinitiators and/or sensitizers, curing using e-beam radiation, such as in the absence of photoinitiators, curing using thermal curing, in the presence or absence of high temperature thermal initiators (and which are generally largely inactive at the jetting temperature), and appropriate combinations thereof.

In such embodiments, the chemical toner may further include an optional radiation curable initiator. For example, if the curable amorphous resin is cured via UV radiation, the chemical toner may include a photoinitiator. Examples of photoinitiators include, such as UV-photo-initiators including, for example, hydroxycyclohexylphenyl ketones; other ketones such as alpha-amino ketone and 4-(2-hydroxyethoxy)phenyl-(2-hydroxy-2-propyl)ketone; benzoins; benzoin alkyl ethers; benzophenones, such as 2,4,6-trimethylbenzophenone and 4-methylbenzophenone; trimethylbenzoylphenylphosphine oxides such as 2,4,6-trimethylbenzoyl-diphenyl-phosphine oxide or phenylbis(2,4,6-trimethylvbenzyoyl) phosphine oxide (BAPO) available as IRGACURE 819 from Ciba; azo compounds; anthraquinones and substituted anthraquinones, such as, for example, alkyl substituted or halo substituted anthraquinones; other substituted or unsubstituted polynuclear quinines; acetophenones, thioxanthones; ketals; acylphosphines; and mixtures thereof. Other examples of photo-initiators include, but not limited to, 2-hydroxy-2-methyl-1-phenyl-propan-1-one and 2-isopropyl-9H-thioxanthen-9-one. In embodiments, the photo-initiator is one of the following compounds or a mixture thereof: a hydroxycyclohexylphenyl ketone, such as, for example, 2-hydroxy-4'-hydroxyethoxy -2-methylpropiophenone or 1-hydroxycyclohexylphenyl ketone, such as, for example, IRGACURE® 184 (Ciba-Geigy Corp., Tarrytown, N.Y.), having the structure:

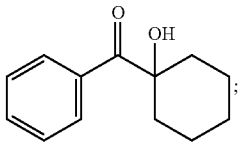

a trimethylbenzoylphenylphosphine oxide, such as, for example, ethyl-2,4,6-trimethylbenzoylphenylphosphinate, such as, for example, LUCIRIN® TPO-L (BASF Corp.), having the formula

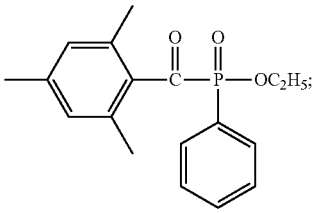

a mixture of 2,4,6-trimethylbenzophenone and 4-methylbenzophenone, such as, for example, SARCURE™ SR1137 (Sartomer); a mixture of 2,4,6-trimethylbenzoyl-diphenylphosphine oxide and 2-hydroxy-2-methyl-1-phenyl-propan-1-one, such as, for example, DAROCUR® 4265 (Ciba Specialty Chemicals); alpha-amino ketone, such as, for example, IRGACURE® 379 (Ciba Specialty Chemicals); 4-(2-hydroxyethoxy)phenyl-(2-hydroxy-2-propyl) ketone, such as, for example, IRGACURE® 2959 (Ciba Specialty Chemicals); 2-isopropyl-9H-thioxanthen-9-one, such as, for example, DAROCUR® ITX (Ciba Specialty Chemicals); and mixtures thereof.

In embodiments, the chemical toner composition contains from about 0.5 to about 15 wt % of radiation curable initiator, such as from about 1 to about 15 wt %, or from about 3 to about 12 wt %, of radiation curable initiator. Of course, other amounts can be used as desired.

The curable amorphous resin and optionally one or more radiation curable initiator are dissolved in the solvent, and is mixed into an suitable medium, for example water, such as deionized water optionally containing a stabilizer, and optionally a surfactant.

Suitable solvents include alcohols, ketones, esters, ethers, chlorinated solvents, nitrogen containing solvents and mixtures thereof. Specific examples of suitable solvents include acetone, methyl acetate, methyl ethyl ketone, tetrahydrofuran, cyclohexanone, ethyl acetate, N,N dimethylformamide, dioctyl phthalate, toluene, xylene, benzene, dimethylsulfoxide, mixtures thereof, and the like. If desired or necessary, the resin and the optional curable initiator can be dissolved in the solvent at elevated temperature of from about 40° C. to about 85° C., such as from about 50° C. to about 80° C. or from about 60° C. to about 70° C., although the temperature is desirably lower than the glass transition temperature or melting point of the resin(s). In embodiments, the curable amorphous resin and the optional curable initiator are dissolved in the solvent at an elevated temperature, but below the boiling point of the solvent, such as from about 2° C. to about 15° C. or from about 5° C. to about 10° C. below the boiling point of the solvent.

Examples of stabilizers include water-soluble alkali metal hydroxides, such as sodium hydroxide, potassium hydroxide, lithium hydroxide, beryllium hydroxide, magnesium hydroxide, calcium hydroxide, or barium hydroxide; ammonium hydroxide; alkali metal carbonates, such as sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. In embodiments, a particularly desirable stabilizer is sodium bicarbonate or ammonium hydroxide. When the stabilizer is used in the composition, it is typically present in amounts of from about 0.1 percent to about 20 percent, such as from about 0.5 percent to about 10 percent, by weight of the resin(s). When such salts are added to the composition as a stabilizer, it is desired in embodiments that incompatible metal salts are not present in the composition. For example, when these salts are used, the composition should be completely or essentially free of zinc and other incompatible metal ions, for example, Ca, Fe, Ba, etc., that form water-insoluble salts. The term "essentially free" refers, for example, to the incompatible metal ions as present at a level of less than about 0.01 percent, such as less than about 0.005 percent or less than about 0.001 percent, by weight of the resins. If desired or necessary, the stabilizer can be added to the mixture at ambient temperature, or it can be heated to the mixture temperature prior to addition.

Optionally, an additional stabilizer such as a surfactant may be added to the above medium such as to afford additional stabilization to the curable amorphous resin. One, two, or more surfactants may be utilized. The surfactants may be selected from ionic surfactants and nonionic surfactants. Anionic surfactants and cationic surfactants are encompassed by the term "ionic surfactants." In embodiments, the use of anionic and nonionic surfactants can additionally help stabilize the aggregation process in the presence of the coagulant, which otherwise could lead to aggregation instability.

In embodiments, the surfactant may be utilized so that it is present in an amount of from about 0.01% to about 10% by weight of the toner composition, for example from about 0.75% to about 5% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA720™, IGEPAL CO-890™, IGEPAL CO-720™, IGEPAL CO-290™, IGEPAL CA-210™, ANTAROX 890™ and ANTAROX 897™, Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, and acids such as abitic acid, which may be obtained from Aldrich, or NEOGEN R™, NEOGEN SC™, NEOGEN RK™ which may be obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL and ALKAQUAT, available from Alkaril Chemical Company, SANIZOL (benzalkonium chloride), available from Kao Chemicals, and the like, and mixtures thereof.

After the stabilizer or stabilizers are added, the resultant mixture can be mixed or homogenized for any desired time.

Next, the mixture is heated to flash off the solvent, and then cooled to room temperature. For example, the solvent flashing can be conducted at any suitable temperature above the boiling point of the solvent in water that will flash off the solvent, such as a temperature of from about 60° C. to about 100° C., such as from about 70° C. to about 90° C. or about 80° C., although the temperature may be adjusted based on, for example, the particular resins and solvent used.

Following the solvent flash step, the curable amorphous resin emulsion may have an average particle diameter in the range of from about 100 to about 500 nanometers, such as from about 130 to about 300 nanometers as measured with a Honeywell MICROTRAC UPA150 particle size analyzer.

In alternative embodiments, the curable amorphous resin emulsion may be prepared by a suitable process, such as, solvent flash or phase inversion emulsification and the like.

Sublimation Colorant

In embodiments, the chemical toner further contains at least one sublimation colorant. However, multiple sublimation colorants may be used. Such colorants may include sublimation dyes and sublimation pigments. Sublimation dyes are commonly referred to as disperse dyes and generally sublime at a temperature between about 120° C. and about 220° C., possibly up to 400° C. Typical dyes, classified in the Color Index under the title "Disperse Dyes", generally chemically belong to groups comprising azo, anthraquinone, phthalocyanine, indophenol, indoaniline, perinone, quinophthalone, acridine, xanthone, diazine, and oxazine dyes, and can be diffused into the toner particles.

Suitable sublimation dyes include, for example, dyes manufactured by Sensient, such as, Intratherm Yellow P-1343NT, Intratherm Yellow P-1346NT, Intratherm Yellow P-346, Intratherm Brilliant Yellow P-348, Intratherm Brilliant Orange P-365, Intratherm Brown P-1301, Intratherm Dark Brown P-1303, Intratherm Pink P-1335NT, Intratherm Brilliant Red P-1314NT, Intratherm Red P-1339, Intratherm Blue P-1305NT, Intratherm Blue P-1404, C.I. Disperse Blue 359, Intratherm Orange P-367 Intratherm Brilliant Blue P-1309, C.I. Disperse Red 60, Intratherm Yellow P-343NT; dyes manufactured by the Organic Dyestuffs Corporation, Orco Transfer Blue 2R, Orco Transfer Scarlet B, Orco Transfer Yellow 3G, dyes manufactured by ECS Specialty Ink & Dyes, Ltd., such as, Subli Blue 770, Subli Red 770, Subli Yellow 781, Subli Black 774. Other suitable examples include C.I. Disperse Yellow 3, 23, 25, 42, 54, 64, 79, 82, 83 , 93, 99, 100, 119, 122, 124, 126, 160, 184:1, 186, 198, 199, 204, 211, 224 and 237; Disperse Blue 60, C.I. Disperse Orange 1, 3, 7, 13, 25, 29 31:1, 33, 49, 54, 55, 66, 73, 118, 119, and 163; C.I. Disperse Red 1, 13, 54, 60, 72, 73, 86 ,88, 91, 92, 93, 111, 126, 127, 134, 135, 143, 145 , 152, 154, 159, 164, 167:1, 177, 181, 204 ,206, 207, 221, 239, 240, 258, 277, 278, 283, 288, 311, 323, 343, 348, 356 and 362, C.I. Disperse Violet 1, 33, C.I. Disperse Blue 3, 14, 19, 26, 56, 60, 73, 79:1, 87, 87:1, 113, 128, 143, 148, 154, 158, 165, 15:1, 165:2, 176, 180, 183, 185, 197, 198, 201, 214, 224, 225, 257, 266, 267, 287, 354, 359, 365 and 368; C.I. Disperse Green 6:1 and 9, and other suitable dye materials. Other examples include Eastman Fast Yellow 8GLF, Eastman Brilliant Red FFBL, Eastman Blue GBN, Eastman Polyester Orange 2RL, Eastman Polyester Yellow GLW, Eastman Polyester Dark Orange RL, Eastman Polyester Pink RL, Eastman Polyester Yellow 5GLS, Eastman Polyester Red 2G, Eastman Polyester Blue GP, Eastman Polyester Blue RL, Eastone Yellow R-GFD, Eastone Red B, Eastone Red R, Eastone Yellow 6GN, Eastone Orange 2R, Eastone Orange 3R, Eastone Orange GRN, Eastman Red 901, Eastman Polyester Blue 4RL, Eastman Polyester Red B-LSW, Eastman Turquoise 4G, Eastman Polyester Blue BN-LSW, (all available from the Eastman Kodak Co., Rochester, N.Y.). However, a disperse dye is not limited to these dyes.

Other dyes useful in the process of making and using this toner composition include ICI Disperse Red; DuPont Disperse Blue 60; Bayer Resiren Red TB; and Bayer Macrolex G. Additional examples of dyes which may also be suitable for use in the toner composition include BASF Lurifix Blue 590, BASF Lurifix Orange, BASF Lurifix Red 380, BASF Lurifix Red 420, BASF Lurifix Yellow 150, ICI Dispersal Red B2B, ICI Dispersal Yellow BGB and ICI Dispersal Blue BN. Such dye materials are also available commercially from Keystone Aniline Corporation, Crompton & Knowles, BASF, Bayer, E.I. du Pont de Nemours & Co., Ciba, ICI, and others. In the foregoing, it is important only that the dye chosen be thermally and chemically stable, be compatible with the polymers in the toner particles and with any other toner additives, and be colorfast.

The sublimation colorant has a low specific heat of from about 1.5 to about 2 Joules per gram-degree Centigrade, and a low latent heat of fusion of from about 20 to about 150 J/g. The melting points of the many of the dyes exemplified above range from about 150° C. to 250° C. Suitable dyes have a specific heat of about 1.8 Joules per gram-degree Centigrade and have a latent heat of fusion between 30 and 120 Joules per gram. All of these dyes sublime easily and are expected to be uniformly imbibed when deposited upon toner particles. Some of the dyes described above are also disclosed in U.S. Pat. No. 4,081,277, the entire disclosure of which is incorporated herein by reference.

The sublimation colorant may be present in the toner composition in any desired or effective amount to obtain the desired color or hue such as, for example, at least from about 0.1 percent by weight of the ink to about 50 percent by weight of the toner, at least from about 0.2 percent by weight of the toner to about 20 percent by weight of the toner, and at least from about 0.5 percent by weight of the toner to about 10 percent by weight of the toner.

Non-Sublimination Pigments

The chemical toner composition may also include a non-sublimation pigment. The non-sublimation pigment is herein defined as any pigment that imparts a color to the toner composition, but does not sublime at a temperature between 120° C. and 300° C. For example, if the toner composition is employed in a transfer printing process, the non-sublimation pigment may be used to print a first colored image on the transfer substrate. The color of the first colored image is the same color as the non-sublimation pigment. After heat and/or pressure is applied to the transfer substrate, a second colored image that may be the same or entirely different from the first colored image is transferred to the permanent substrate. Such a process would be useful to record different images for document security purposes.

Examples of suitable pigments for the non-sublimation pigment include PALIOGEN Violet 5100 (commercially available from BASF); PALIOGEN Violet 5890 (commercially available from BASF); HELIOGEN Green L8730 (commercially available from BASF); LITHOL Scarlet D3700 (commercially available from BASF); SUNFAST Blue 15:4 (commercially available from Sun Chemical); Hostaperm Blue B2G-D (commercially available from Clariant); Hostaperm Blue B4G (commercially available from Clariant); Permanent Red P-F7RK; Hostaperm Violet BL (commercially available from Clariant); LITHOL Scarlet 4440 (commercially available from BASF); Bon Red C (commercially available from Dominion Color Company); ORACET Pink RF (commercially available from Ciba); PALIOGEN Red 3871 K (commercially available from BASF); SUNFAST Blue 15:3 (commercially available from Sun Chemical); PALIOGEN Red 3340 (commercially available from BASF); SUNFAST Carbazole Violet 23 (commercially available from Sun Chemical); LITHOL Fast Scarlet L4300 (commercially available from BASF); SUNBRITE Yellow 17 (commercially available from Sun Chemical); HELIOGEN Blue L6900, L7020 (commercially available from BASF); SUNBRITE Yellow 74 (commercially available from Sun Chemical); SPECTRA PAC C Orange 16 (commercially available from Sun Chemical); HELIOGEN Blue K6902, K6910 (commercially available from BASF); SUNFAST Magenta 122 (commercially available from Sun Chemical); HELIOGEN Blue D6840, D7080 (commercially available from BASF); Sudan. Blue OS (commercially available from BASF); NEOPEN Blue FF4012 (commercially available from BASF); PV Fast Blue B2GO1 (commercially available from Clariant); IRGALITE Blue BCA (commercially available from Ciba); PALIOGEN Blue 6470 (commercially available from BASF); Sudan Orange G (commercially available from Aldrich), Sudan Orange 220 (commercially available from BASF); PALIOGEN Orange 3040 (BASF); PALIOGEN Yellow 152, 1560 (commercially available from BASF); LITHOL Fast Yellow 0991 K (commercially available from BASF); PALIOTOL Yellow 1840 (commercially available from BASF); NOVOPERM Yellow FGL (commercially available from Clariant); Ink Jet Yellow 4G VP2532 (commercially available from Clariant); Toner Yellow HG (commercially available from Clariant); Lumogen Yellow D0790 (commercially available from BASF); Suco-Yellow L1250 (commercially available from BASF); Suco-Yellow D1355 (commercially available from BASF); Suco Fast Yellow DI 355, D1351 (commercially available from BASF); HOSTAPERM Pink E 02 (commercially available from Clariant); Hansa Brilliant Yellow 5GX03 (commercially available from Clariant); Permanent Yellow GRL 02 (commercially available from Clariant); Permanent Rubine L6B 05 (commercially available from Clariant); FANAL Pink D4830 (commercially available from BASF); CINQUASIA Magenta (commercially available from DU PONT); PALIOGEN Black L0084 (commercially available from BASF); Pigment Black K801 (commercially available from BASF); and carbon blacks such as REGAL 330™ (commercially available from Cabot), Nipex 150 (commercially available from Degussa) Carbon Black 5250 and Carbon Black 5750 (commercially available from Columbia Chemical), and the like, as well as mixtures thereof.

The non-sublimation colorant may be present in the toner in any desired or effective amount to obtain the desired color or hue such as, for example, at least from about 0.1 percent by weight of the toner to about 20 percent by weight of the toner, at least from about 0.2 percent by weight of the toner to about 15 percent by weight of the toner, and at least from about 0.5 percent by weight of the toner to about 10 percent by weight of the toner.

Preparation of Sublimation Colorant Dispersion

In formulating the sublimation colorant containing EA toner, it is necessary to first prepare a stable dispersion of the sublimation colorant in an aqueous solvent, the sublimination colorant particles having a particle size less than 400 μm. The dispersion may also include a suitable dispersing aid, such as, for example dispersant MF, dispersant NND, sodium naphthalene sulphonate and/or surfactants such as, for example, the SURFYNOL products marketed commercially by Air Products, TAMOL products by Pam & Haas, and BYK products by Byk-Chemie, among others. The dispersions may then be treated to reduce the particle size, for example by grinding, homogenization, grinding followed by homogenization under high pressure, or other mechanical means.

Emulsion Aggregation (EA) Toner Preparation

A pre-toner mixture is prepared by combining the sublimation colorant, and optionally other materials, surfactant, and the curable amorphous resin. In embodiments, the pH of the pre-toner mixture is adjusted to from about 2.5 to about 4. The pH of the pre-toner mixture may be adjusted by an acid such as, for example, acetic acid, nitric acid or the like. Additionally, in embodiments, the pre-toner mixture optionally may be homogenized. If the pre-toner mixture is homogenized, homogenization may be accomplished by mixing at from about 600 to about 4,000 revolutions per minute. Homogenization may be accomplished by any suitable means, including, for example, an IKA ULTRA TURRAX T50 probe homogenizer.

Following the preparation of the pre-toner mixture, an aggregate mixture is formed by adding at least one aggregating agent (coagulant or flocculent) to the pre-toner mixture. The aggregating agent is generally an aqueous solution of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the pre-toner mixture at a temperature that is below the glass transition temperature ($T_g$) of the emulsion resin. In some embodiments, the aggregating agent may be added in an amount of from about 0.05 to about 3.0 pph with respect to the weight of toner. The aggregating agent may be added to the pre-toner mixture over a period of from about 0 to about 60 minutes. Aggregation may be accomplished with or without maintaining homogenization. Aggregation is accomplished at temperatures that are about or higher than room temperature.

Thus, the process calls for blending the amorphous polyester resin and/or the crystalline polyester resin, together in the presence of a sublimation colorant and optionally other additives, heating the blend slowly from room temperature to about from 28 to 60° C. in order to provide aggregated particles with an average size of from about 3 microns to about 12 microns, such as about 6 micron particles, and have a circularity of, for example, about 0.900 to about 0.990 as measured on the FPIA SYSMEX analyzer.

Following aggregation, the aggregates may be coalesced. Coalescence may be accomplished by heating the aggregated mixture to a temperature that is about 5° C. to about 20° C. above the $T_g$ of the curable amorphous resin. Generally, the aggregated mixture is heated to a temperature of about 50° C. to about 60° C. In embodiments, the mixture may also be stirred at from about 100 to about 750 revolutions per minute to coalesce the particles. Coalescence may be accomplished over a period of from about 1 to about 20 hours.

Optionally, during coalescence, the particle size of the toner particles may be controlled and adjusted to a desired size by adjusting the pH of the mixture. Generally, to control the particle size, the pH of the mixture is adjusted to between about 5 to about 12 using a base such as, for example, sodium hydroxide.

After coalescence, the mixture may be cooled to room temperature. After cooling, the mixture of toner particles of some embodiments may be washed with water and then dried. Drying may be accomplished by any suitable method for drying including freeze drying. Freeze drying is typically accomplished at temperatures of about −80° C. for a period of about 48 hours.

Upon aggregation and coalescence, the toner particles of embodiments have an average particle size of from about 1 to about 15 microns, in further embodiments of from about 4 to about 15 microns, and, in particular embodiments, of from about 6 to about 11 microns, such as about 7 microns. The volume geometric size distribution ($GSD_V$) by volume for (D84/D50) of the toner particles of embodiments may be in a range of from about 1.10 to about 1.55, and in particular embodiments of less than about 1.35.

In embodiments, the process may include the use of surfactants, emulsifiers, and other additives such as those discussed above. Likewise, various modifications of the above process will be apparent and are encompassed herein.

The toner particles described herein may further include other components, such as sublimation colorants and non-sublimation pigments, and various external additives.

Surface Additives

The chemical toner may also include any suitable surface additives. Examples of surface additives are surface treated fumed silicas, for example TS-530 from Cabosil Corporation, with an 8 nanometer particle size and a surface treatment of hexamethyldisilazane; NAX50 silica, obtained from DeGussa/Nippon Aerosil Corporation, coated with HMDS; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS (decyltrimethoxysilane); P-25 from Degussa Chemicals with no surface treatment; alternate metal oxides such as aluminum oxide, and as a lubricating agent, for example, stearates or long chain alcohols, such as UNILIN 700, and the like. In general, silica is applied to the toner surface for toner flow, tribo enhancement, admix control, improved development and transfer stability, and higher toner blocking temperature. $TiO_2$ is applied for improved relative humidity (RH) stability, tribo control and improved development and transfer stability. Examples of suitable $SiO_2$ and $TiO_2$ are those surface treated with compounds including DTMS (decyltrimethoxysilane) or HMDS (hexamethyldisilazane).

The $SiO_2$ and $TiO_2$ may generally possess a primary particle size greater than approximately 30 nanometers, or at least 40 nanometers, with the primary particles size measured by, for instance, transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are more specifically applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC× Size" (surface area coverage times the primary particle size of the additive in nanometers) for each of the silica and titania particles, or the like, for which all of the additives should, more specifically, have a total SAC×Size range of, for example, about 4,500 to about 7,200. The ratio of the silica to titania particles is generally from about 50 percent silica/50 percent titania to about 85 percent silica/15 percent titania (on a weight percentage basis).

Calcium stearate and zinc stearate can be selected as an additive for the toners describe above, the calcium and zinc stearate primarily providing lubricating properties. Also, the calcium and zinc stearate can provide developer conductivity and tribo enhancement, both due to its lubricating nature. In addition, calcium and zinc stearate enables higher toner charge and charge stability by increasing the number of contacts between toner and carrier particles. A suitable example is a commercially available calcium and zinc stearate with greater than about 85 percent purity, for example from about 85 to about 100 percent pure, for the 85 percent (less than 12 percent calcium oxide and free fatty acid by weight, and less than 3 percent moisture content by weight) and which has an average particle diameter of about 7 microns and is available from Ferro Corporation (Cleveland, Ohio). Examples are SYNPRO® Calcium Stearate 392A and SYNPRO® Calcium Stearate NF Vegetable or Zinc Stearate-L. Another example is a commercially available calcium stearate with greater than 95 percent purity (less than 0.5 percent calcium oxide and free fatty acid by weight, and less than 4.5 percent moisture content by weight), and which stearate has an average particle diameter of about 2 microns and is available from NOF Corporation (Tokyo, Japan). In embodiments, the toners contain from, for example, about 0.1 to about 5 weight percent titania, about 0.1 to about 8 weight percent silica, or from about 0.1 to about 4 weight percent calcium or zinc stearate.

Wax

Optionally, a wax may also be combined with the chemical toner composition. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX polyethylene waxes from Baker Petrolite, wax emulsions available from Michaelman, Inc. and the Daniels Products Company, EPOLENE N-15 commercially available from Eastman Chemical Products, Inc., and VISCOL 550-P, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550, SUPERSLIP 6530 available from Micro Powder Inc., fluorinated waxes, for example POLYFLUO 190, POLYFLUO 200, POLYSILK 19, POLYSILK 14 available from Micro Powder Inc., mixed fluorinated, amide waxes, for example MICROSPERSION 19 also available from Micro Powder Inc., imides, esters, quaternary amines, carboxylic acids or acrylic polymer emulsion, for example JONCRYL 74, 89, 130, 537, and 538, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

To incorporate the wax into the toner, it is desirable for the wax to be in the form of one or more aqueous emulsions or dispersions of solid wax in water, where the solid wax particle size is usually in the range of from about 100 to about 300 nm.

In embodiments, the desired charge distribution for the toner particles in both the A-zone and the C-zone is from about −2 mm to about −25 mm displacement, such as from about −4 mm to about −20 mm displacement.

The charge performance or distribution of a toner is frequently demarcated as q/d (mm). The toner charge (q/d) is measured as the midpoint of the toner charge distribution. The charge is reported in millimeters of displacement from the zero line in a charge spectrograph using an applied transverse electric filed of 100 volts per cm. The q/d measure in mm can be converted to a value in fC/μm by multiplying the value in mm by 0.092.

In embodiments, it is desired that the ratio of the charge distribution in the A-zone to the C-zone be as close to 1 as possible. This ratio (C-zone/A-zone) is frequently referred to as the relative humidity (RH) sensitivity by those skilled in the art. In embodiments, the RH sensitivity may be in a range of less than about 10, such as from about 0.03 to about 8.

The toner particles described herein also exhibit acceptable toner cohesion. Toner cohesion may be measured using a Hosokawa Micron PT-R tester, available from Micron Powders Systems. Toner cohesion is typically expressed in percent (%) cohesion. Percent cohesion may be measured by placing a known mass of toner, namely 2 grams, on top of a set of stacked screens, a top screen that has 53 micron mesh or openings, a middle screen that has 45 micron mesh or openings, and a bottom screen that has 38 micron mesh or openings, and vibrating the screens and toner for a fixed time at a fixed vibration amplitude, namely 90 seconds at 1 millimeter vibration amplitude. All screens are made of stainless steel. The percent cohesion is then calculated as follows:

$$\% \text{ cohesion} = 50 \cdot A + 30 \cdot B + 10 \cdot C$$

where A is the mass of toner remaining on the 53 micron screen, B is the mass of toner remaining on the 45 micron screen, and C is the mass of toner remaining on the 38 micron screen. The percent cohesion of the toner is related to the amount of toner remaining on each of the screens at the end of the time. A percent cohesion value of 100% corresponds to all the toner remaining on the top screen at the end of the vibration step and a percent cohesion of 0% corresponds to all of the toner passing through all three screens, in other words, no toner remaining on any of the three screens at the end of the vibration step. The greater the percent cohesion for toners, the less the toner particles are able to flow. In embodiments, the toners may have a percent cohesion in the range of, for example, from about 30% to about 80%, such as from about 35% to about 75%, or from about 40% to about 65%.

The toner particles of the present disclosure can be made to have the following physical properties when no external additives are present on the toner particles.

The toner particles can have a surface area, as measured by the well known BET method, of about 1.3 to about 6.5 $m^2/g$. For example, for cyan, yellow and black toner particles, the BET surface area can be less than 2 $m^2/g$, such as from about 1.4 to about 1.8 $m^2/g$, and for magenta toner, from about 1.4 to about 6.3 $m^2/g$.

It is also desirable to control the toner particle size and limit the amount of both fine and coarse toner particles in the toner. In an embodiment, the toner particles have a very narrow particle size distribution with a lower number ratio geometric standard deviation (GSD) of approximately 1.10 to approximately 1.55, or approximately less than 1.35. The toner particles of the present disclosure also can have a size such that the upper geometric standard deviation (GSD) by volume is in the range of from about 1.10 to about 1.50, such as from about 1.15 to about 1.30, or less than 1.35. These GSD values for the toner particles of the present disclosure indicate that the toner particles are made to have a very narrow particle size distribution.

Circularity is also a control process parameter associated with the toner being able to achieve optimal machine performance and can be measured with a EPIA-2100, manufactured by Sysmex. For a completely circular sphere the circularity would be 1.000. The toner particles can have circularity of about 0.900 to 0.990 and, such as from about 0.940 to about 0.985.

The minimum fixing temperature (MFT) is the minimum temperature (also called toner crease) at which acceptable adhesion of the toner to the image-receiving substrate occurs, as determined by, for example, a creasing test, For example, the creasing test used to obtain the MFT measurement involves folding an image fused at a specific temperature, and rolling a standard weight across the fold. The folded image is then unfolded and analyzed under the microscope and assessed a numerical grade based on the amount of crease showing in the fold. This procedure is repeated at various temperatures until the minimum fusing temperature (showing very little crease) is obtained.

In embodiments, the MET of the toner particles in the toner composition may be from about 115° C. to about 145° C., from about 120° C. to about 140° C., from about 125° C. to about 140° C. and from about 125° C. to about 135° C.

In embodiments, the toner composition has a gloss, measured at the minimum fixing temperature, of from about 30 to about 80 gloss units, such as from about 40 to about 70 gloss units as measured on a BYK 75 degree micro gloss meter. "Gloss units" refers to Gardner Gloss Units measured on plain paper (such as Xerox 90 gsm COLOR XPRESSIONS+ paper or Xerox 4024 paper). Crease fix MET is measured by folding images that have been fused over a wide range of fusing temperatures and then rolling a defined mass across the folded area. The print can also be folded using a commercially available folder such as the Dupla D-590 paper folder. The sheets of paper are then unfolded and toner that has been fractured from the sheet of paper is wiped from the surface. Comparison of the fractured area is then made to an internal reference chart. Smaller fractured areas indicate better toner adhesion and the temperature required to achieve acceptable adhesion is defined as the crease fix MFT. In embodiments, the toner compositions have a MFT of about 115° C. to about 145° C., such as about 120° C. to about 140° C. or about 130° C.

Developer Composition (with Carrier)

The toner particles of the disclosure can optionally be formulated into a developer composition by mixing the toner particles with carrier particles. Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include iron, iron alloys, steel, nickel, iron ferrites, including ferrites that incorporate strontium, magnesium, manganese, copper, zinc, and the like, magnetites, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of acrylic and methacrylic polymers, such as methyl methacrylate, acrylic and methacrylic copolymers with fluoropolymers or with monoalkyl or dialkylamines, fluoropolymers, polyolefins, polystyrenes, such as polyvinylidene fluoride resins, terpolymers of styrene, methyl methacrylate, and a silane, such as triethoxy silane, tetrafluoroethylenes, other known coatings and the like.

The carrier particles can be mixed with the toner particles in various suitable combinations. The toner concentration is usually about 2 to about 10 percent by weight of toner and about 90 to about 98 percent by weight of carrier. However, different toner and carrier percentages may be used to achieve a developer composition with desired characteristics.

In embodiments, any known type of image development system may be used in an image developing device, including, for example, magnetic brush development, jumping single-component development, hybrid scavengeless development (HSD), etc. These development systems are well known in the art, and further explanation of the operation of these devices to form an image is thus not necessary herein.

Once the image is formed with toners/developers described herein via a suitable image development method, such as transfer printing, the image is then printed to an image-receiving medium such as paper and the like and then transferred to different image-receiving medium. Transfer printing is a term broadly used to describe several different families of technology for making an image on a substrate. Those technologies include dye diffusion printing and thermal mass transfer printing.

Transfer Printing Method

In embodiments, the toner composition described herein may be employed in a secondary transfer process. As defined herein, the "secondary transfer process" is the process of transferring only the sublimation colorant to a permanent image-receiving substrate, while the non-transferred components remain on the transfer carrier sheet. The transfer may be accomplished by placing the transfer carrier sheet with the image printed thereon in contact with the surface of the permanent image-receiving substrate, and applying either heat or force to the transfer carrier sheet until the sublimation colorant transfers onto the surface of the permanent image-receiving substrate and forms an image. However, before being transferred to the permanent image-receiving substrate, the chemical toner composition described herein must be printed on the transfer sheet.

The toner composition described herein are printed onto the transfer sheet using any electrostatographic or xerographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to the transfer sheet. In embodiments, the toners may be used in developing an image in an image-developing device utilizing a fuser roll member.

Fuser roll members are contact fusing devices that are within the purview of those skilled in the art, in which heat and pressure from the roll may be used to fuse the toner composition to the transfer sheet. In embodiments, the fuser member may be heated to a temperature above the fusing temperature of the toner composition, but below the sublimation temperature of the sublimation colorant, for example to temperatures of from about 70° C. to about 160° C., in embodiments from about 80° C. to about 150° C., in other embodiments from about 90° C. to about 140° C., to transfer the image onto the transfer sheet. However, the image transferred to the transfer sheet must be a negative of the image desired on the image-receiving substrate.

To fix the toner to the image-receiving substrate, such as a sheet of paper or transparency, hot roll fixing is commonly used. In this method, the image-receiving substrate with the toner image thereon is transported between a heated fuser member and a pressure member with the image face contacting the fuser member. Upon contact with the heated fuser member, the toner melts and adheres to the image-receiving medium, forming a fixed image. This fixing system is very advantageous in heat transfer efficiency and is especially suited for high speed electrophotographic processes.

The fuser member suitable for use herein comprises at least a substrate and an outer layer. Any suitable substrate can be selected for the fuser member. The fuser member substrate may be a roll, belt, flat surface, sheet, film, drelt (a cross between a drum or a roller), or other suitable shape used in the fixing of thermoplastic toner images to a suitable copy substrate. Typically, the fuser member is a roll made of a hollow cylindrical metal core, such as copper, aluminum, stainless steel, or certain plastic materials chosen to maintain rigidity and structural integrity, as well as being capable of having a polymeric material coated thereon and adhered firmly thereto. The supporting substrate may be a cylindrical sleeve, preferably with an outer fluoropolymeric layer of from about 1 to about 6 millimeters. In one embodiment, the core, which can be an aluminum or steel cylinder, is degreased with a solvent and cleaned with an abrasive cleaner prior to being primed with a primer, such as DOW CORNING 1200, which can be sprayed, brushed, or dipped, followed by air drying under ambient conditions for thirty minutes and then baked at about 150° C. for about 30 minutes.

Also suitable are quartz and glass substrates. The use of quartz or glass cores in fuser members allows for a lightweight, low cost fuser system member to be produced. Moreover, the glass and quartz help allow for quick warm-up, and are therefore energy efficient. In addition, because the core of the fuser member comprises glass or quartz, there is a real possibility that such fuser members can be recycled. Moreover, these cores allow for high thermal efficiency by providing superior insulation.

If the fuser member is a belt, the substrate can be of any desired or suitable material, including plastics, such as ULTEM, available from General Electric, ULTRAPEK, available from BASF, PPS (polyphenylene sulfide) sold under the tradenames FORTRON, available from Hoechst Celanese, RYTON R-4, available from Phillips Petroleum, and SUPEC, available from General Electric; PAI(polyamide imide), sold under the tradename TORLON 7130, available from Amoco; polyketone (PK), sold under the tradename KADEL E1230, available from Amoco; PT (polyimide); polyaramide; PEEK (polyether ether ketone), sold under the tradename PEEK 450GL30, available from Victrex; polyphthalamide sold under the tradename AMODEL, available from Amoco; PES (polyethersulfone); PEI (polyetherimide); PAEK (polyaryletherketone); PBA (polyparabanic acid); silicone resin; and fluorinated resin, such as PTFE (polytetrafluoroethylene); PFA (perfluoroalkoxy); FEP (fluorinated ethylene propylene); liquid crystalline resin (XYDAR), available from Amoco; and the like, as well as mixtures thereof. These plastics can be filled with glass or other minerals to enhance their mechanical strength without changing their thermal properties. In embodiments, the plastic comprises a high temperature plastic with superior mechanical strength, such as polyphenylene sulfide, polyimide imide, polyimide, polyketone, polyphthalamide, polyether ether ketone, polyethersulfone, and polyetherimide. Suitable materials also include silicone rubbers. Examples of belt-configuration fuser members are disclosed in, for example, U.S. Pat. Nos. 5,487,707 and 5,514,436, the disclosures of each of which are totally incorporated herein by reference. A method for manufacturing reinforced seamless belts is disclosed in, for example, U.S. Pat. No. 5,409,557, the disclosure of which is totally incorporated herein by reference.

The fuser member may include an intermediate layer, which can be of any suitable or desired material. For example, the intermediate layer can comprise a silicone rubber of a thickness sufficient to form a conformable layer. Suitable silicone rubbers include room temperature vulcanization (RTV) silicone rubbers, high temperature vulcanization (HTV) silicone rubbers, and low temperature vulcanization (LTV) silicone rubbers. These rubbers are known and are readily available commercially such as SILASTIC 735 black RTV and SILASTIC 732 RTV, both available from Dow Corning, and 106 RTV Silicone Rubber and 90 RTV Silicone Rubber, both available from General Electric. Other suitable silicone materials include the silanes, siloxanes (preferably polydimethylsiloxanes), such as fluorosilicones, dimethylsilicones, liquid silicone rubbers, such as vinyl crosslinked heat curable rubbers or silanol room temperature crosslinked materials, and the like. Other materials suitable for the intermediate layer include polyimides and fluoroelastomers. The intermediate layer may have a thickness of from about 0.05 to about 10 millimeters, such from about 0.1 to about 5 millimeters or from about 1 to about 3 millimeters.

The layers of the fuser member can be coated on the fuser member substrate by any desired or suitable means, including normal spraying, dipping, and tumble spraying techniques. A flow coating apparatus as described in U.S. Pat. No. 6,408,753, the disclosure of which is totally incorporated herein by reference, can also be used to flow coat a series of fuser members. In embodiments, the polymers may be diluted with a solvent, such as an environmentally friendly solvent, prior to application to the fuser substrate. Alternative methods, however, can be used for coating layers, including methods described in U.S. Pat. No. 6,099,673, the disclosure of which is totally incorporated herein by reference.

The outer layer of the fuser member may comprise a fluoropolymer such as polytetrafluoroethylene (PTFE), fluorinated ethylenepropylene copolymer (FEP), polyfluoroalkoxy (PEA), perfluoroalkoxy polytetrafluoroethylene (PFA TEFLON), ethylene chlorotrifluoro ethylene (ECTFE), ethylene tetrafluoroethylene (ETFE), polytetrafluoroethylene perfluoromethylvinylether copolymer (MFA), combinations thereof and the like.

In embodiments, the outer layer may further comprise at least one filler. Examples of fillers suitable for use herein include a metal filler, a metal oxide filler, a doped metal oxide filler, a carbon filler, a polymer filler, a ceramic filler, and mixtures thereof.

In embodiments, an optional adhesive layer may be located between the substrate and the intermediate layer. In further embodiments, the optional adhesive layer may be provided between the intermediate layer and the outer layer. The optional adhesive intermediate layer may be selected from, for example, epoxy resins and polysiloxanes.

The transfer sheet may be comprised of a substrate sheet or multiple layers coated directly on top of the substrate sheet. Examples of additional layers coated on the substrate sheet include a peel layer, a scratch resistant layer, and/or an adhesive layer. Examples of transfer sheets are described in U.S. Pat. Nos. 7,033,974, 7,138,163, 6,951,696, 6,946,424, 7,510,617, 6,849,311 and 6,800,166, the disclosures of which are incorporated by reference herein in their entirety.

Any substrate sheet used in conventional transfer sheets may be used as long as the substrate sheet has some level of heat resistance and strength. Suitable examples of substrate sheets include tissue papers, such as glassine paper, capacitor paper, and paraffin paper; and films of plastics, for example, polyesters, such as polyethylene terephthalate and polyethylene naphthalate, polypropylene, cellophane, polycarbonate, cellulose acetate, polyethylene, polyvinyl chloride, polystyrene, nylon, polyimide, polyvinylidene chloride, and ionomers. The thickness of the substrate sheet may be properly varied depending upon materials for the substrate sheet so that the substrate sheet has proper strength, heat resistance and other properties. However, the thickness of the substrate sheet may be from about 10 to about 100 μm, from about 20 to about 80 μm and from about 30 to 75 μm.

The emulsion aggregation toner composition may be employed in a dye diffusion thermal transfer processes, wherein only the sublimitable colorant is transferred to the image-receiving substrate by a dye diffusion thermal transfer process. Details of this process are described in U.S. Pat. Nos. 5,436,217, 5,902,771, 5,917,530, 6,052,139 and 6,057,264, each of which are incorporated by reference herein in their entirety.

Before the printed image transferred to a permanent image-receiving substrate, the image is cured, so that only the sublimation colorant (not the curable amorphous resin and other chemical toner composition components) are transferred to the permanent image-receiving substrate. This curing can occur either during fusing, for example, via thermal curing wherein the polyester resin(s) crosslink upon heating or after fusing, for example, using actinic radiation. Examples of curing methods include thermal curing, ultraviolet radiation curing and free radical curing, which are described in U.S. Patent Application Pub. No. 2006/0100300, the disclosure of which is incorporated by reference in its entirety.

In embodiments where the toner composition is crosslinkable, such crosslinking may be accomplished in any suitable manner. For example, the toner resin may be crosslinked during fusing of the toner to the substrate where the toner resin is crosslinkable at the fusing temperature. Crosslinking also may be effected by heating the fused image to a temperature at which the toner resin will be crosslinked, for example in a post-fusing operation. In embodiments, crosslinking may be effected at temperatures of from about 200° C. or less, in embodiments from about 70° C. to about 200° C., in other embodiments from about 80° C. to about 180° C.

In further embodiments, the curing may occur after fusing via an actinic radiation energy source having a wavelength in the ultraviolet or visible region of the spectrum, accelerated particles, such as electron beam radiation, thermal such as heat or infrared radiation, or the like. In embodiments, the energy is actinic radiation because such energy provides excellent control over the initiation and rate of crosslinking. Suitable sources of actinic radiation include, but are not limited to, mercury lamps, xenon lamps, carbon arc lamps, tungsten filament lamps, lasers, sunlight, and the like.

Ultraviolet radiation, especially from a medium pressure mercury lamp with a high speed conveyor under UV light, such as about 20 to about 70 m/min., can be used in embodiments, wherein the UV radiation is provided at a wavelength of about 200 to about 500 nm for about less than one second, although the disclosure is not limited thereto. In embodiments, the speed of the high speed conveyor can be about 15 to about 35 m/min. under UV light at a wavelength of about 200 to about 500 nm for about 10 to about 50 milliseconds (ms). The emission spectrum of the UV light source generally overlaps the absorption spectrum of the UV-initiator. Optional curing equipment includes, but is not limited to, a reflector to focus or diffuse the UV light, and a cooling system to remove heat from the IN light source.

In embodiments, the chemical toner composition describe above is brought into contact with a permanent image-receiving sheet and selectively, in accordance with a pattern information signal, heated to a temperature of about 100° C. to about 300° C. with a thermal printing head provided with a plurality of juxtaposed heat-generating resistors. Upon heating, the sublimation colorant is transferred from the selectively heated regions of the image receiver sheet and forms a pattern thereon. The shape and density of pattern on the permanent image-receiving substrate depend upon the pattern and intensity of heat applied to the toner composition. Examples of permanent image-receiving substrates include various materials such as wood, plastic, natural cloth, synthetic cloth, carpet material, concrete, glass, metal such as steel, porcelain and ceramic. Virtually any substrate can be used that can withstand a temperature of at least 145° C. for at least 10 seconds. The surface of suitable substrate could be coated by such as polyester coating material.

Embodiments described above will now be further illustrated by way of the following examples.

EXAMPLE

Toner Preparation

Into a 2 liter beaker is added an emulsion containing 141.36 grams of poly(propoxylated bisphenol A co-fumarate) resin (an unsaturated amorphous polyester resin (45.84 weight percent) and 48 grams of an emulsion (30 weight percent) of an unsaturated crystalline polyester resin comprising ethylene glycol and a mixture of dodecanedioic acid and fumaric acid co-monomers, and 46.17 grams of Disperse Blue 359 (a sublimation dye dispersion) (17 weight percent), available from Sun Chemical Corporation. 35.84 grams of $Al_2(SO_4)_3$ (1 weight percent) is added in as an aggregating agent under homogenization.

The mixture is subsequently transferred to a 2 liter Buchi reactor and heated to about 44° C. for aggregation at 700 rpm. The particle size is monitored with a Coulter Counter until the particles reach a volume average particle size of 6 microns with a GSD of 1.21. Subsequently, the pH of the reaction slurry is increased to 7.5 using NaOH to freeze the toner particle growth. After freezing the particle growth, the reaction mixture is heated to 85° C. for coalescence. The toner slurry is then cooled to room temperature, separated by sieving (25 micron), filtered, washed, and freeze dried.

Image Formation and Fusing

An unfused image can be made using a modified DC12 printer and imaged onto transfer sheets such as 120 gsm Digital Color Elite Gloss (DCEG) coated paper as or 120 gsm White Instro Glass coated paper. The unfused image has a density of approximately 0.50 mg/cm$^2$ and is a reverse image of final image. The developer is comprised of 35 grains of the above toner and 365 grams of carrier. The target image used for gloss, crease and hot offset is a square, 6.35 cm by 6.35 cm, and is positioned near the center of the transfer sheet page.

Samples are fused offline using the iGen 3 fuser, Fuser roll process speed is 468 mm/s (100 PPM) and the fuser roll nip width is ~14.0 mm/s, which gives a nominal 30 ms dwell.

Image Curing

The fusing images are cured using a Fusion UV system in the following manner. After the belt speed of Fusion UV system is adjusted to 32 ft/min, the fused images are placed on the transport belt and exposed to a UV lamp for 4 passes to ensure the image is completely cures.

Image Transfer

The cured images are transferred to a polyester fabric by heating a hot plate to 190° C. and placing the transfer sheet on the hot plate with the cured image facing up. After placing the obverse side of polyester fabric on top of the cured image, a iron plate is placed directly on top of the polyester fabric for around and pressure is applied for about 150 seconds. The image is transferred to the polyester, while the cured component of the toner remain on the transfer sheet.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A chemical toner composition comprising:

at least one curable amorphous unsaturated polyester resin having a molecular weight of from about 1,000 to about 50,000;

at least one crystalline polyester resin having a molecular weight of from about 1,000 to about 50,000;

at least one non-sublimation pigment; and at least one sublimation dye, wherein the chemical toner is configured such that it may be employed in a secondary transfer process.

2. The chemical toner composition of claim 1, wherein the at least one curable amorphous unsaturated polyester resin is a resin selected from the group consisting of a resin including one or more fumarate groups, a resin including one or more maleate groups, an epoxy functionalized resin, a polyol functionalized resin, an acid functionalized resin, and an isocyanate functionalized resin.

3. The chemical toner composition of claim 1, wherein the at least one sublimation dye is selected from the group consisting of azo dyes, anthroquinone dyes and phthalocyanine dyes.

4. The chemical toner composition of claim 1, wherein the crystalline polyester resin comprises a polyester selected from the group consisting of poly(ethylene-adipate), polypropylene-adipate), poly(butylene-adipate), poly(pentylene-adipate), poly(hexylene-adipate), poly(octylene-adipate), poly(ethylene-succinate), polypropylene-succinate), poly(butylene-succinate), poly(pentylene-succinate), poly (hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecanedioate), poly(decylene-dodecandioate), poly(undecylene-dodecandioate), poly(dodecylene-dodecandioate), poly(ethylene-fumarate), polypropylene-fumarate), poly(butylene-fumarate), poly(pentylene-fumarate), poly(hexylene-fumarate), poly(octylene-fumarate), poly(nonylene-fumarate), poly(decylene-fumarate), copoly (5-sulfoisophthaloyl)-copoly(ethylene-adipate), copoly(5-sulfoisophthaloyl)-copoly(propylene-adipate), copoly(5-sulfo-isophthaloyl)-copoly(butylene-adipate), copoly(5-sulfo-isophthaloyl)-copoly(hentylene-adipate), copoly(5-sulfo-isophthaloyl)-copoly(hexylene-adipate), copoly (5-sulfo-isophthaloyl)-copoly(octylene-adipate),copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate),copoly(5-sulfo-isophthaloyl)copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sul fo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), and combinations thereof.

5. The chemical toner composition of claim 1, having a Tg (onset) of from about 50 to about 60° C., a circularity of about 0.900 to about 0.990, and a minimum fixing temperature of about 115° C. to about 145° C.

6. A chemical toner composition having toner particles comprising:

at least one curable amorphous unsaturated polyester resin having a molecular weight of from about 1,000 to about 50,000;

at least one crystalline polyester resin having a molecular weight of from about 1,000 to about 50,000;

at least one non-sublimation pigment;

optionally one or more radiation curable initiator;

at least one aggregating agent; and at least one sublimation dye, wherein the chemical toner is configured such that it may be employed in a secondary transfer process.

7. The chemical toner composition of claim 6, wherein the at least one curable amorphous unsaturated polyester resin is a resin selected from the group consisting of a resin including one or more fumarate groups, a resin including one or more maleate groups, an epoxy functionalized resin, a polyol functionalized resin, an acid functionalized resin, and an isocyanate functionalized resin.

8. The chemical toner composition of claim 6, wherein the at least one crystalline polyester resin comprises a polyester selected from the group consisting of poly(ethylene-adipate), poly(propylene-adipate), poly(butylene-adipate), poly(pentylene-adipate), poly(hexylene-adipate), poly(octylene-adipate), poly(ethylene-succinate), polypropylene-succinate), poly(butylene-succinate), poly(pentylene-succinate), poly(hexylene-succinate), poly(octylene-succinate), poly(ethylene-sebacate), polypropylene-sebacate), poly(butylene-sebacate), poly(pentylene-sebacate), poly(hexylene-sebacate), poly(octylene-sebacate), poly(nonylene-sebacate), poly(decylene-sebacate), poly(undecylene-sebacate), poly(dodecylene-sebacate), poly(ethylene-dodecanedioate), poly(propylene-dodecanedioate), poly(butylene-dodecanedioate), poly(pentylene-dodecanedioate), poly(hexylene-dodecanedioate), poly(octylene-dodecanedioate), poly(nonylene-dodecanedioate), poly(decylene-dodecandioate), poly(undecylene-dodecandioate), poly(dodecylene-dodecandioate), poly(ethylene-fumarate), poly(propylene-fumarate), poly(butylene-fumarate), poly(pentylene-fumarate), poly(hexylene-fumarate), poly(octylene-fumarate), poly(nonylene-fumarate), poly(decylene-fumarate), copoly(5-sulfoisophthaloyl)-copoly(ethylene-adipate), copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene- adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl)-copoly(propylene-succinate), copoly(5-sulfoisophthaloyl)-copoly(butylene-succinate), copoly(5-sulfoisophthaloyl)-copoly(pentylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylenes-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-isophthaloyl)-copoly(butylene-adipate), copoly(5-sulfo-isophthaloyl)-copoly(pentylene-adipate), copoly(5-sulfo-isophthaloyl)-copoly(hexylene-adipate), and combinations thereof.

9. A secondary transfer printing method, the method comprising:

applying the chemical toner composition of claim 1 in a desired pattern onto a transfer sheet to form an image on the transfer sheet;

curing the image on the transfer sheet;

bringing the transfer sheet into pressure contact with the permanent image-receiving substrate and heating the transfer sheet; and forming an image on the permanent image-receiving substrate.

10. The method of claim 9, wherein the at least one curable amorphous unsaturated polyester resin is a resin selected from the group consisting of a resin including one fumarate groups, a resin including one or more maleate groups, an epoxy functionalized resin, a polyol functionalized resin, an acid functionalized resin, and an isocyanate functionalized resin.

11. The method of claim 9, wherein the curing is a thermal curing that occurs during or after fusing of the chemical toner composition to the transfer sheet.

12. The method of claim 9, wherein the curing is an ultraviolet curing that occurs during or after fusing the chemical toner composition to the transfer sheet.

13. The method of claim 9, wherein the permanent image-receiving substrate is comprised of a material selected from the group consisting of wood, plastic, natural cloth, synthetic cloth, carpet material, concrete, glass, metal, porcelain and ceramic.

14. The chemical toner composition of claim 1, wherein the sublimation dye sublimes at a temperature from about 120° C. to about 400° C., and the non-sublimation pigment does not sublime at a temperature from about 120° C. to about 300° C.

15. The chemical toner composition of claim 1, wherein the sublimation dyes is selected from the group consisting of C.I. Disperse Blue 359, C.I. Disperse Red 60, C.I. Disperse Yellow 3, C.I. Disperse Yellow 23, C.I. Disperse Yellow 25, C.I. Disperse Yellow 42, C.I. Disperse Yellow 54, C.I. Disperse Yellow 64, C.I. Disperse Yellow 79, C.I. Disperse Yellow 82, C.I. Disperse Yellow 83, C.I. Disperse Yellow 93, C.I. Disperse Yellow 99, C.I. Disperse Yellow 100, C.I. Disperse Yellow 119, C.I. Disperse Yellow 122, C.I. Disperse Yellow 124, C.I. Disperse Yellow 126, C.I. Disperse Yellow 160, C.I. Disperse Yellow 184:1, C.I. Disperse Yellow 186, C.I. Disperse Yellow 198, C.I. Disperse Yellow 199, C.I. Disperse Yellow 204, C.I. Disperse Yellow 211, C.I. Disperse Yellow 224, C.I. Disperse Yellow 237, Disperse Blue 60, C.I. Disperse Orange 1, C.I. Disperse Orange 3, C.I. Disperse Orange 7, C.I. Disperse Orange 13, C.I. Disperse Orange 25, C.I. Disperse Orange 29, C.I. Disperse Orange 31:1, C.I. Disperse Orange 33, C.I. Disperse Orange 49, C.I. Disperse Orange 54, C.I. Disperse Orange 55, C.I. Disperse Orange 66, C.I. Disperse Orange 73, C.I. Disperse Orange 118, C.I. Disperse Orange 119, C.I. Disperse Orange 163, C.I. Disperse Red 1, C.I. Disperse Red 13, C.I. Disperse Red 54, C.I. Disperse Red 60, C.I. Disperse Red 72, C.I. Disperse Red 73, C.I. Disperse Red 86, C.I. Disperse Red 88, C.I. Disperse Red 91, C.I. Disperse Red 92, C.I. Disperse Red 93, C.I. Disperse Red 111, C.I. Disperse Red 126, C.I. Disperse Red 127, C.I. Disperse Red 134, C.I. Disperse Red 135, C.I. Disperse Red 143, C.I. Disperse Red 145, C.I. Disperse Red 152, C.I. Disperse Red 154, C.I. Disperse Red 159, C.I. Disperse Red 164, C.I. Disperse Red 167:1, C.I. Disperse Red 177, C.I. Disperse Red 181, C.I. Disperse Red 204, C.I. Disperse Red 206, C.I. Disperse Red 207, C.I. Disperse Red 221, C.I. Disperse Red 239, C.I. Disperse Red 240, C.I. Disperse Red 258, C.I. Disperse Red 277, C.I. Disperse Red 278, C.I. Disperse Red 283, C.I. Disperse Red 288, C.I. Disperse Red 311, C.I. Disperse Red 323, C.I. Disperse Red 343, C.I. Disperse Red 348, C.I. Disperse Red 356, C.I. Disperse Red 362, C.I. Disperse Violet 1, 33, C.I. Disperse Blue 3, C.I. Disperse Blue 14, C.I. Disperse Blue 19, C.I. Disperse Blue 26, C.I. Disperse Blue 56, C.I. Disperse Blue 60, C.I. Disperse Blue 73, C.I. Disperse Blue 79:1, C.I. Disperse Blue 87, C.I. Disperse Blue 87:1, C.I. Disperse Blue 113, C.I. Disperse Blue 128, C.I. Disperse Blue 143, C.I. Disperse Blue 148, C.I. Disperse Blue 154, C.I. Disperse Blue 158, C I. Disperse Blue 165, C.I. Disperse Blue 15:1, C.I. Disperse Blue 165:2, C.I. Disperse Blue 176, C.I. Disperse Blue 180, C.I. Disperse Blue 183, C.I. Disperse Blue 185, C.I. Disperse Blue 197, C.I. Disperse Blue 198, C.I. Disperse Blue 201, C.I. Disperse Blue 214, C.I. Disperse Blue 224, C.I. Disperse Blue 225, C.I. Disperse Blue 257, C.I. Disperse Blue 266, C I. Disperse Blue 267, C.I. Disperse Blue 287, C.I. Disperse Blue 354, C.I. Disperse Blue 359, C.I. Disperse Blue 365, C.I. Disperse Blue 368, C.I. Disperse Green 6:1, and C.I. Disperse Green 9.

* * * * *